US007367407B2

(12) United States Patent
Lannert

(10) Patent No.: US 7,367,407 B2
(45) Date of Patent: May 6, 2008

(54) TOWED SNOWPLOW AND METHOD OF PLOWING

(75) Inventor: Robert Glenn Lannert, Jefferson City, MO (US)

(73) Assignee: Cives Corporation, Roswell, GA (US)

( * ) Notice: Subject to any disclaimer, the term of this patent is extended or adjusted under 35 U.S.C. 154(b) by 164 days.

(21) Appl. No.: 11/029,476

(22) Filed: Jan. 6, 2005

(65) Prior Publication Data

US 2006/0143952 A1 Jul. 6, 2006

(51) Int. Cl.
*A01B 15/00* (2006.01)

(52) U.S. Cl. ..... 172/684.5; 172/786; 37/267; 37/270; 37/279

(58) Field of Classification Search ..... 37/219, 37/266, 268, 270, 279, 142.5; 172/684.5, 172/786, 787, 817; 404/84.1, 94, 96, 118, 404/119; 299/39.4
See application file for complete search history.

(56) References Cited

U.S. PATENT DOCUMENTS

| | | | | | |
|---|---|---|---|---|---|
| 1,204,772 | A | | 11/1916 | Hornecker | |
| 3,703,932 | A | * | 11/1972 | Tuttle et al. | 172/288 |
| 3,800,884 | A | | 4/1974 | Estes | |
| 3,908,289 | A | * | 9/1975 | Ross | 37/231 |
| 4,070,031 | A | | 1/1978 | Whittaker | |
| 4,247,129 | A | | 1/1981 | Whittaker | |
| 4,369,590 | A | * | 1/1983 | Miller | 37/231 |
| 4,506,465 | A | * | 3/1985 | Johnson | 37/268 |
| 4,571,860 | A | * | 2/1986 | Long | 37/197 |
| 4,583,598 | A | | 4/1986 | Knels | |
| 4,592,429 | A | | 6/1986 | Watts | |
| 4,938,295 | A | | 7/1990 | Marrandi et al. | |
| 5,245,771 | A | * | 9/1993 | Walsh | 37/269 |
| 5,400,859 | A | * | 3/1995 | Harrell | 172/219 |
| 5,515,623 | A | | 5/1996 | Weeks | |
| 6,151,809 | A | * | 11/2000 | Altheide | 37/268 |
| 6,453,582 | B1 | * | 9/2002 | Fulton, III | 37/197 |
| 6,915,863 | B2 | * | 7/2005 | Raducha et al. | 172/452 |
| 2003/0132014 | A1 | | 7/2003 | Marshall | |

FOREIGN PATENT DOCUMENTS

| | | | |
|---|---|---|---|
| FR | 002662567 | A1 | 12/1991 |

* cited by examiner

*Primary Examiner*—Thomas B. Will
*Assistant Examiner*—Jamie L McGowan
(74) *Attorney, Agent, or Firm*—Buchanan Ingersoll & Rooney PC

(57) ABSTRACT

A towed snowplow includes a frame which is carried by at least one wheel. The frame includes at least one moldboard and is arranged to be towed behind a vehicle and movable from a transport position directly behind the vehicle to a deployed position in which the frame extends diagonally from the vehicle to enable plowing of pavement alongside and to the rear of the towing vehicle.

30 Claims, 9 Drawing Sheets

TOWED SNOWPLOW AND METHOD OF PLOWING

FIELD OF THE INVENTION

The present invention relates to plows and more particularly relates to plowing arrangements for clearing snow from pavement such as a road, a highway or a runway as well as to methods of clearing snow from pavement.

BACKGROUND OF THE INVENTION

Typically, snow is removed from pavement by a truck that is provided with a snowplow having a moldboard that is mounted on the front end of the truck. Various arrangements are known for raising and lowering the moldboard of the snow plow as desired and for changing the angle that the moldboard of the snow plow makes with the longitudinal center axis of the truck, and therefore with respect to the longitudinal axis of the lane of pavement being cleared.

The moldboard of the snow plow may be selectively raised and lowered so that the plow truck may be driven with the lowermost edge of the moldboard either in contact (for conducting a plowing operation) or out of contact with the road, such as when the truck is being driven over pavement which has already been cleared of snow. Also, the snow plow is typically arranged to enable the angle of the plow with respect to the truck to be changed so that the snow plow can be used to divert snow to the left or to the right of the truck or used to push snow directly in front of the truck such as when clearing a driveway or parking lot.

Various wing plows and other attachments are also known in the snow removal art which effectively extend the width of the lane that can be plowed by a single truck in a single pass. However, such wing plows are typically mounted at one side of the truck and present significant problems for the operation of the truck in plowing situations. For example, the use of a wing plow produces significant torque and disruptive forces on the truck frame and the suspension of the snowplow truck. Also, the maximum practical length of a wing plow is relatively small and does not readily permit additional lanes of pavement to be cleared of snow during a single pass of the snowplow vehicle.

Accordingly, the need remains for a snowplow arrangement in which a relatively wide strip of pavement may be cleared of snow in a single pass of a snowplow vehicle, preferably without requiring an additional operator and without requiring an additional vehicle.

Accordingly, the present invention provides a snowplow which is towed by a vehicle such as a municipal truck and which can travel at relatively high speeds on highways and on roads while occupying generally only one lane of pavement or less. When it is desired to plow the pavement, the towed snowplow can then be quickly deployed to either the left or the right of the vehicle, depending upon the configuration of the towed snowplow, to plow either to the left or to the right of the towing vehicle. In this way, the towing vehicle together with the towed snowplow can simultaneously clear several adjacent lanes of a multilane roadway system or highway, as well as pavement shoulders, airport runways or other wide areas. The towed snowplow is configured to not require an additional operator for the towed snowplow and so the multiple lanes of pavement may be cleared of snow in a single pass of the combined towing vehicle and towed snowplow using only one truck and one operator.

It is a particular advantage of the preferred embodiments of the present invention that the towed snowplow can be transported from location to location like a trailer that is towed behind the motorized vehicle, such as a municipal truck, and then the towed snowplow can be deployed to the right (or left depending upon the configuration of the towed snowplow) using steering axles or pivoting axles to cause the trailer to swing out to one side of the towing truck. The towed snowplow automatically deflects or slides in the event that the towed snowplow blade(s) or moldboard(s) strike an obstacle, without incurring major damage to either the towed snowplow or to the towing vehicle.

In the preferred embodiments of the towed snowplow according to the present invention, roads and highways may be more quickly cleared of snow and other winter precipitation which improves safety by reducing accidents and by reducing the number of stranded vehicles and travelers. Because the towed snowplow does not require a second operator in the towing vehicle, the preferred embodiments of the present invention improve efficiency and production for snow clearing operations and reduce the need for additional numbers of snowplow trucks and operators.

The preferred embodiments of the present invention enable snow plow operations to also plow soft shoulders of roadways without placing the snowplow truck physically onto the shoulder of the pavement. In addition, plowing operations in mountainous situations are relatively safer because the snowplow truck may maintain a safer distance from the outside edge of the pavement and thereby more easily avoid inadvertently driving off of the roadway.

The wide plowing capability of the preferred embodiments of the present invention enables the towing vehicle and towed snowplow to plow irregular cross sections more quickly and efficiently as well as providing an arrangement to cut, blow or squeegee pavement by using two cutting edges.

Specifically, the towed snowplows according to the preferred embodiments of the present invention are much safer to use than conventional front and side (wing) plows which may be mounted on the front, the middle, or the rear of snowplow trucks. These conventional side (wing) plows can present major dynamic loads on the plow, as well as on the push frames and the truck frames, on the chassis of the snowplow, as well as on the axles and wheels of the snowplow truck.

The towed snowplow according to the present invention can strike relatively large or even permanent obstacles and deflect without causing great stress to the towing vehicle.

The preferred embodiments of the present invention can be used to plow more safely at relatively higher speeds than most or all conventionally known snowplows, while being stable, when compared to side or wing plows, which often tend to hop, lope, bounce or porpoise. In this way, the towed snowplow according to the present invention is suitable for use at relatively higher speeds while plowing on interstate highways as well as on high speed expressways.

Side or wing plows also cause significant loading on their deployed side while simultaneously causing the other side of the snowplow truck to become relatively much lighter. If a side or wing plow is relatively large, it can often overload the tires of the snowplow truck especially on the side of the truck where the side or wing plow is deployed. Overloading of the tires and the suspension of a snowplow truck presents a safety hazard and is likewise illegal in many states. The towed snowplow according to the preferred embodiments of the present invention does not overload the front steering axles of the towing vehicle as can occur with side or wing plows.

It is also common in some situations to initially plow the pavement or highway surface so as to remove snow. Subsequently, the snowplow truck is used to plow the shoulders of the roadway. This practice places the snowplow truck (typically heavily loaded with salt or sand or gravel) upon the dirt, sod or improved shoulder of the roadway. However, the heavily loaded trucks can make ruts in soft shoulders or can damage seal coats or other improved shoulders. The towed snowplow of the present invention can be used to plow highway shoulders without placing the loaded towing truck physically onto the shoulder, thus reducing shoulder damage.

The preferred embodiments of the present invention also enable the towed snowplow to be moved from one site to the next (while not in a deployed or plowing configuration) while located within a single conventional lane of traffic and without encroaching outside of the lane like wing plows and other conventionally known plowing systems.

The towed snowplow according to the present invention may have one or more moldboards totaling generally from 10 feet to 40 feet or more which may be towed directly behind the towing vehicle from a storage location such as a maintenance shop to the pavement to be plowed.

In the preferred embodiments of the present invention, the towed snowplow is steered from the driver's seat of the towing vehicle which allows the driver or operator of the snowplow truck to selectively deploy and retract the towed snowplow from the transport position (directly behind the towed vehicle) to the plowing position (diagonally behind the vehicle) in 200' or less.

In addition to moving the towed snowplow between the transport position and the deployed position, the steering of the towed snowplow can also be used to cause the plow to favor the left or right side during transport or to steer and negotiate the towed snowplow around hard turns. Typically during relatively gradual curves, such as are common on major highways and interstate road systems, the towed snowplow will remain in either the transport position or in the deployed position without additional steering.

During a plowing operation, the driver or operator of the vehicle can easily vary the plowing width of the towed snowplow such as to accommodate turn lanes or temporary increases or decreases in pavement widths. When in the deployed position, the towed snowplow of the present invention is stable at any desired angle with respect to the towing vehicle.

The towed snowplow according to the present invention can be easily steered around obstacles and then returned to its plowing or deployed position. Accordingly, the towing truck may remain in one lane of pavement without deviating and the operator may use the towed snowplow to plow around an obstacle such as a parked vehicle located on the highway shoulder. After passing the obstacle, the operator may rapidly return the towed snowplow to resume the plowing of one or more additional lanes of pavement. In addition, the towed snowplow is able to pivot around or easily pass over obstructions such as raised pavement markers, joints and other obstacles.

The towed snowplow can easily hook to conventional dump trucks, especially to municipal snowplow trucks, which have pintle hitches. Front and side plows typically require the installation of additional hardware that is attached or otherwise hooked to the truck frames or to bumpers. The towed snowplow of the present invention, however, can use the standard hitches normally used by trucks for pulling pups or trailers along with the standard hydraulic and electrical hookups conventionally provided on such trucks for use with towed trailers.

SUMMARY OF THE INVENTION

In the present invention, a snowplow is arranged to be towed behind a vehicle, with the snowplow comprising a frame having a longitudinal axis. The frame is carried by at least one wheel and preferably by four wheels or more arranged about at least two axles. The wheel or wheels are selectively movable between a first position and a second position, with each wheel being generally aligned with the longitudinal axis of the frame when the wheel is in the first position and the wheel is selectively angled with respect to the longitudinal axis of the frame when the wheel is in the second position. The frame carries at least one moldboard which is used to plow snow when the device is in the second position.

In the preferred embodiments, the frame of the snowplow may be pivotably connected to a vehicle whereby the frame may be towed by the vehicle. The wheel or wheels are remotely steerable, preferably from within the vehicle, and the moldboard may be selectively raised and lowered.

In the preferred embodiments of the present invention, a snowplow which is arranged to be towed behind a vehicle, comprises a frame having a longitudinal axis. The frame is carried by a plurality of wheels which are selectively movable between a first position and a second position. Each wheel is generally aligned with the longitudinal axis of the frame when the plurality of wheels is in the first position and each wheel is selectively angled with respect to the longitudinal axis of the frame when the plurality of wheels is in the second position. A plurality of moldboards is carried by the frame. Preferably, the frame is pivotably connected to a vehicle whereby the frame may be towed by the vehicle. The frame may be towed generally directly behind the vehicle when the plurality of wheels is in the first position and the frame may be towed generally diagonally with respect to a centerline of the vehicle when the plurality of wheels is in the second position. The frame preferably defines a length and a width, with the plurality of moldboards together extending generally along the entire length of the frame and the plurality of moldboards may be selectively raised and lowered with respect to the frame. In addition, it is preferable that each of the plurality of moldboards may be selectively raised and lowered with respect to the frame from within the vehicle. The snowplow preferably defines an overall width and an overall length, with the overall width of the snowplow being about 102 inches or less. Likewise, the plurality of moldboards together preferably define an overall length sufficient to plow at least 120 inches of pavement.

The preferred embodiments of the present invention also include a combination snowplow truck and towed snowplow, comprising a truck which is provided with a front moldboard having a front moldboard which may be selectively raised and lowered. The towed snowplow comprises a frame which is pivotably connected to the truck at a rear end of the truck. The frame has a longitudinal axis and a plurality of wheels. The frame is carried by several wheels which are selectively movable between a first position and a second position. Each wheel is generally aligned with the longitudinal axis of the frame when the wheels are in the first position and each of the wheels is selectively angled with respect to the longitudinal axis of the frame when the plurality of wheels is in the second position, and a plurality of moldboards is carried by the frame.

In the preferred embodiments of the combination snowplow truck and towed snowplow, the frame is towed generally directly behind the truck when the plurality of wheels is in the first position and the frame is towed generally diagonally with respect to a centerline of the truck when the plurality of wheels is in the second position.

In a method of plowing snow from pavement according to the present invention a frame is towed behind a vehicle from a rear hitch with the frame being carried by at least one wheel. The frame is moved from a transport position with the frame positioned directly behind the vehicle to a deployed position in which the frame extends diagonally from the rear hitch of the vehicle. As desired, at least one moldboard carried by the frame is lowered into a plowing position. The moldboard is then used to plow snow from pavement in a path alongside the vehicle. Subsequently, as desired, the moldboard is raised out of the plowing position and the frame is moved from the deployed position back to the transport position.

BRIEF DESCRIPTION OF THE DRAWING FIGURES

The present invention will appear more clearly from the following detailed description of several embodiments illustrated in the enclosed figures in which.

DETAILED DESCRIPTION OF THE INVENTION

Figure 1:
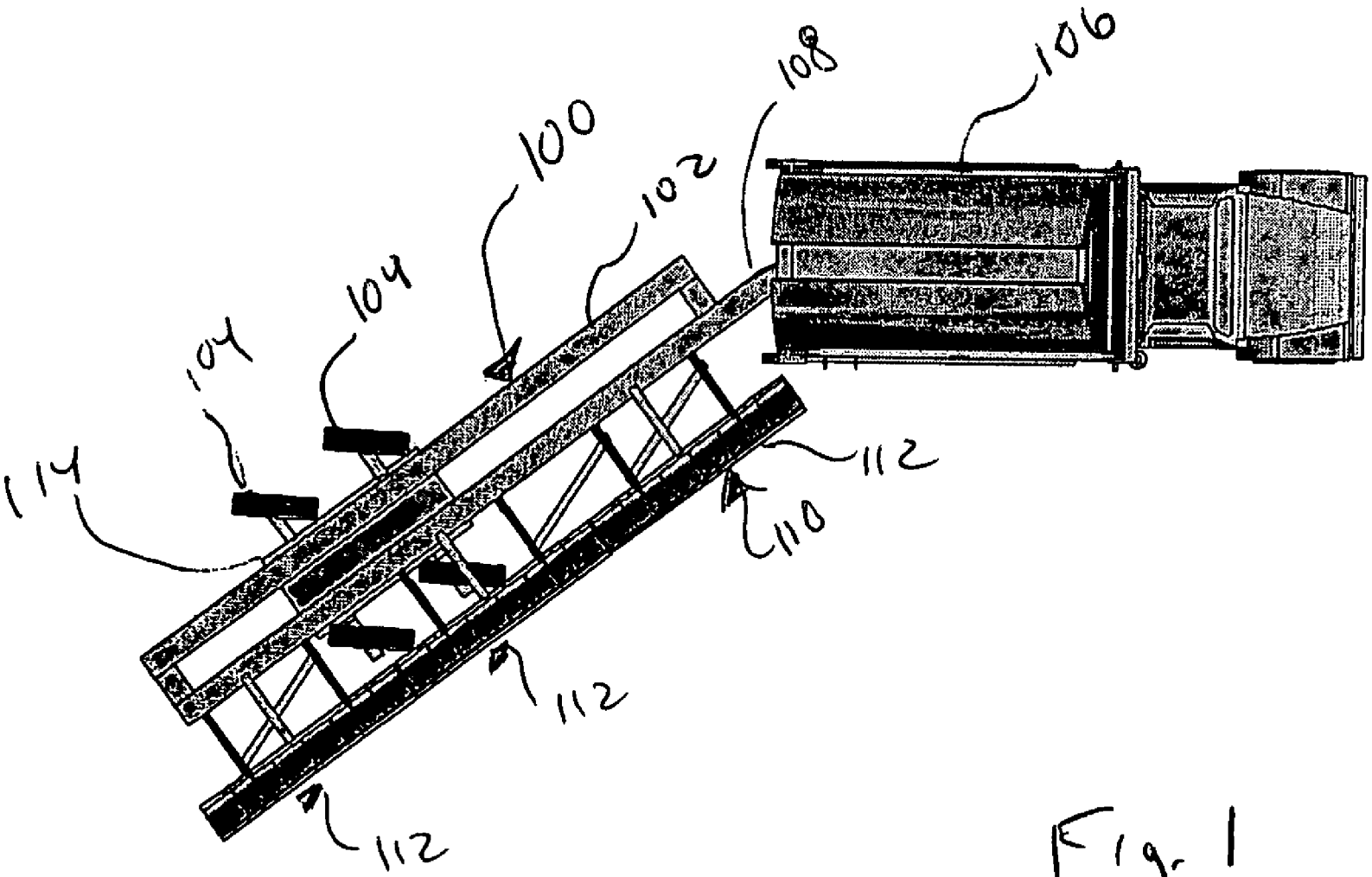
FIG. 1 is a top view of a towing vehicle and a towed snowplow in the deployed position according to the present invention.

With reference to FIG. 1, a towed snowplow 100 according to the present invention includes a frame 102 which is carried by at least one wheel 104. In the preferred embodiment, the frame 102 is a rectangular structure having a length and a width. Preferably, the frame is relatively long and relatively narrow in order to minimize the width of the towed snowplow when being transported directly behind a towing vehicle 106 while enabling the towed snowplow to plow a significantly wide strip of pavement when in a deployed position.

Figure 10:
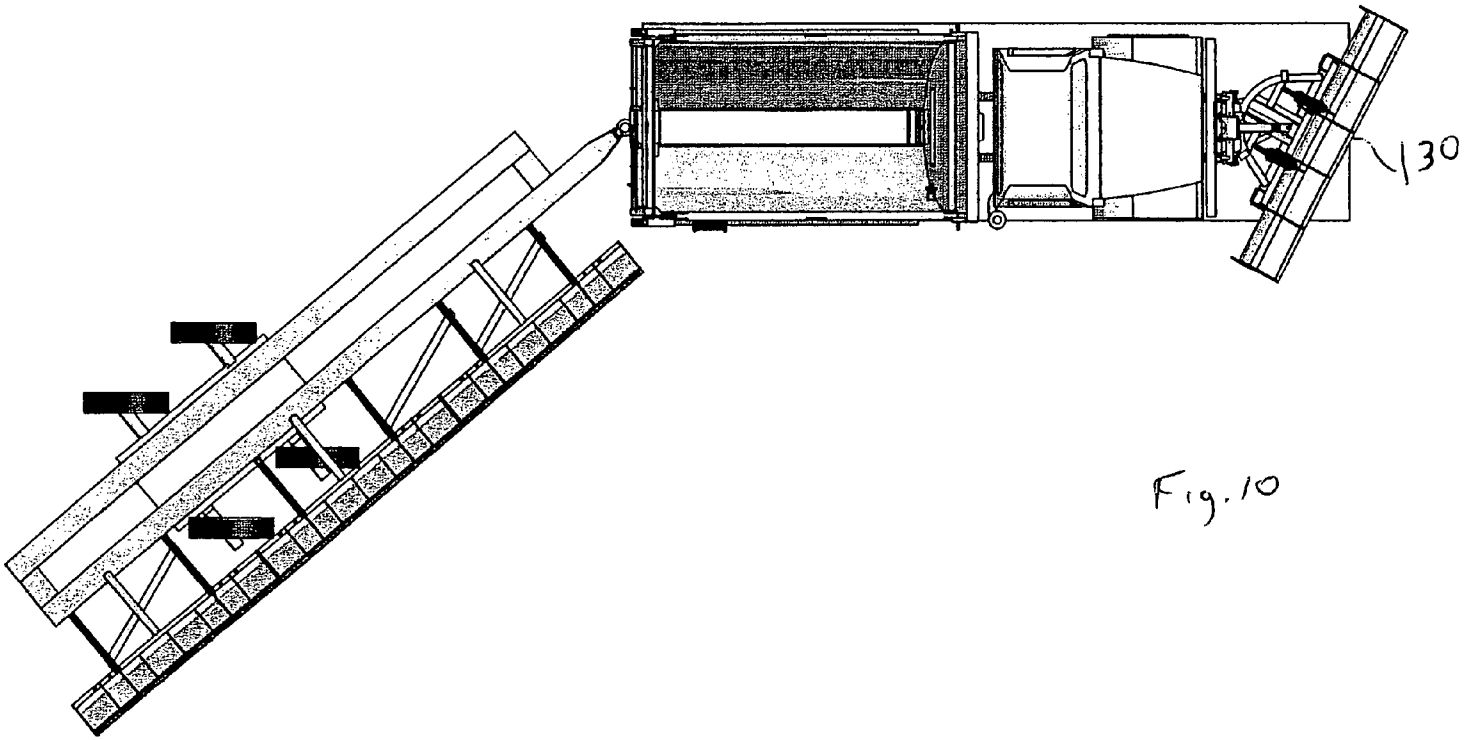
FIG. 10 is a top view of the towed snowplow of FIG. 1 towed in the deployed position by a vehicle provided with a front snowplow.
Figure 11:
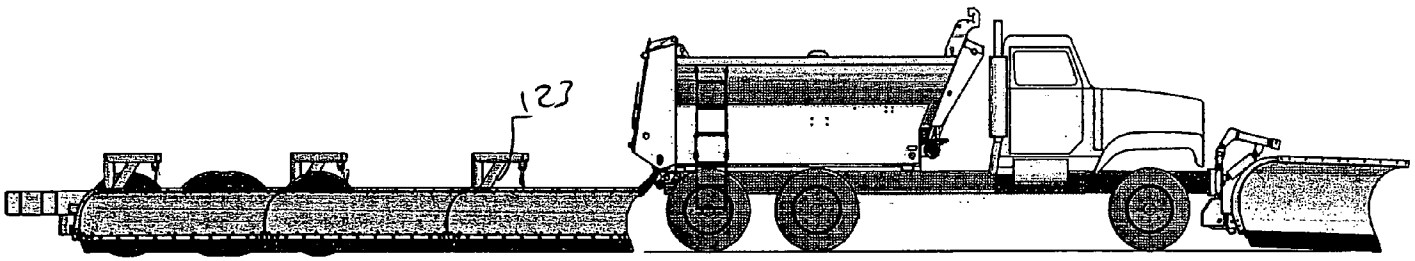
FIG. 11 is a side view of the arrangement of FIG. 10.
Figure 12:
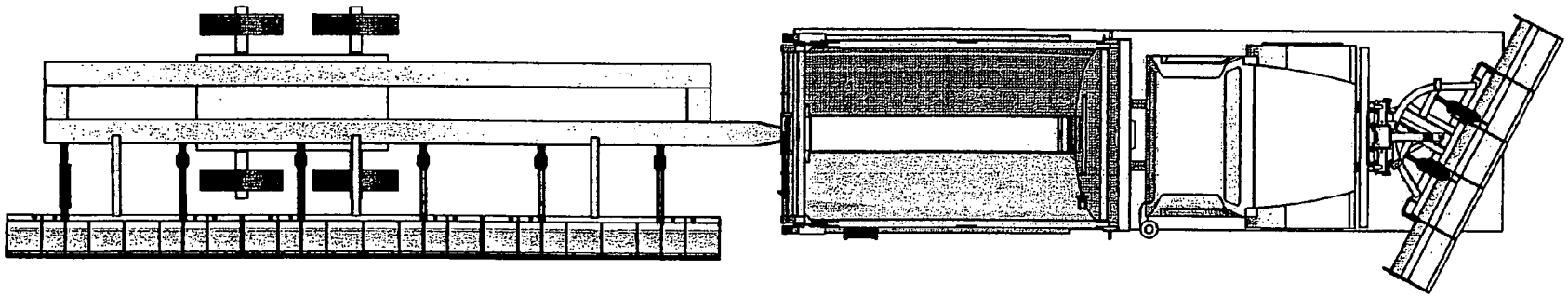
FIG. 12 is a top view of the towed snowplow of FIG. 1 towed in the transport position by a vehicle provided with a front snowplow; and, FIG. 13 is a side view of the arrangement of FIG. 12.
Figure 13:
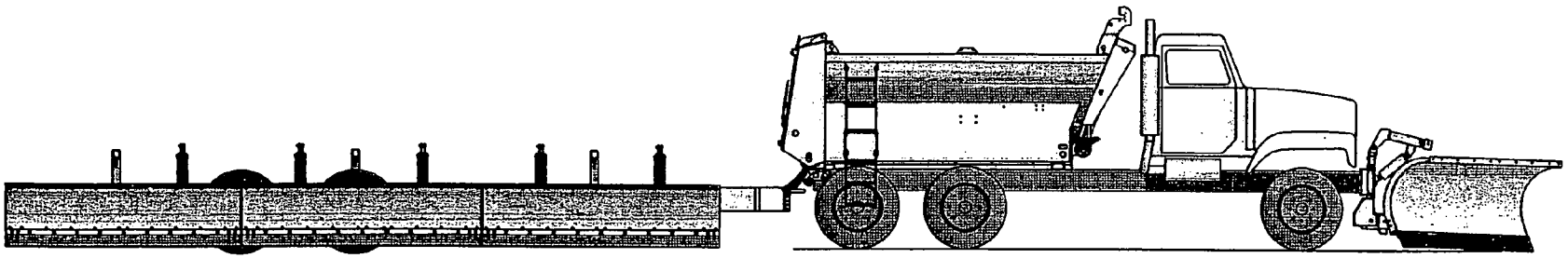

In FIG. 1, the towing vehicle 106 may typically be a snowplow truck with or without a front moldboard (see FIG. 10). The conventional municipal or commercial snowplow truck typically is provided with a pintle hitch for towing a trailer or other device along with hydraulic lines as well as air brake lines and electrical wiring for brake lights and warning lights to accommodate conventional trailers and other devices configured to be towed behind the truck.

The frame 102 preferably has an arm 108 or extension that extends parallel to a centerline of the towed snowplow to facilitate connection of the frame to the pintle hitch or other towing connection of the truck. The frame is preferably relatively lightweight and may be formed from conventional box beams or other structural members but the frame is preferably sufficiently rigid to provide adequate support for a series of moldboards 110 carried by the frame 102.

In the preferred embodiment of FIG. 1, the towed snowplow is provided with three generally identical moldboards 112 which are mounted on the frame in a side by side manner so as to effectively present a single moldboard during plowing operations. A suitable, conventional arrangement for mounting the moldboards on the frame of the towed snowplow is provided along with an arrangement for selectively raising and lowering the moldboards with respect to the frame 102 and, more importantly, with respect to the pavement to be plowed.

The frame 102 in the preferred embodiment is carried by four wheels 104 which are mounted on a sub-frame 114 which enables the wheels to be steered relative to the sub-frame 114 and relative to the frame 102 of the towed snowplow. The four wheels 104 preferably comprise suitable, conventional steerable front wheels such as may be found on a snowplow truck.

Although the preferred embodiment includes two steerable axle arrangements mounted one behind the other, the towed snowplow may also have only a single wheel or only a single pair of wheels, especially if some arrangement is provided to maintain the frame in a substantially horizontal configuration. In the preferred embodiment, four wheels are arranged about two axles in order to provide a stable platform for maintaining the frame in a generally horizontal position especially when the moldboards are in a raised position which provides a torque about the longitudinal axis of the frame. Moreover, the towed snowplow may have more than four wheels, each of which is steerable, if desired, especially in embodiments in which the length of the towed snowplow is relatively long.

Although the preferred embodiments of the towed snowplow include steerable wheels, the towed snowplow may have one or more wheels with a fixed orientation relative to the sub-frame 114. An arrangement such as a ring gear and drive motor is provided between the sub-frame 114 and the frame 102 to rotate the sub-frame 114 relative to the frame 102. In this way, the wheel or wheels may be effectively "steered" by moving the subframe relative to the frame 102 to move the towed snowplow between a transport position directly behind the towing vehicle and a deployed position for plowing operations.

The three moldboards 112 may be configured so as to be raised and lowered simultaneously or individually, as desired. In addition, the moldboards 112 may be mounted on the frame 102 using any suitable, conventional mounting arrangement such as is known in the art for front moldboards. For example, the moldboards may be mounted to the frame using resilient members (such as urethane) which are received within a mounting member so as to enable mounting arms and the moldboard to pivot about the mounting member in the event that an obstruction is encountered by the moldboard such as is disclosed in U.S. Pat. No. 6,219,943, U.S. Pat. No. 6,354,025, and U.S. Pat. No. 6,536,141 of the assignee Cives Corporation and incorporated herein by reference.

In the embodiment of FIG. 1, the wheels 104 have been turned (or steered) so as to have the plane of each of the wheels angled with respect to a longitudinal axis of the towed snowplow. As a result, the towed snowplow will move from a transport position directly behind the towing vehicle 106 (see also, FIG. 2) to a deployed position in which the towed snowplow forms an angle with respect to the towing vehicle about the pivot connection of the frame 102 with the truck.

Preferably, the leading edge of the moldboards 112 extends to generally the outside edge of the strip of pavement plowed by a front moldboard mounted on the towing vehicle (see FIG. 10). The moldboard of the towed snowplow in the configuration of FIG. 1 can then plow one or more additional lanes of pavement to the right side of the towing vehicle, depending upon the length of the towed snowplow 100 and the angle of the towed snowplow with respect to the vehicle.

Figure 2:
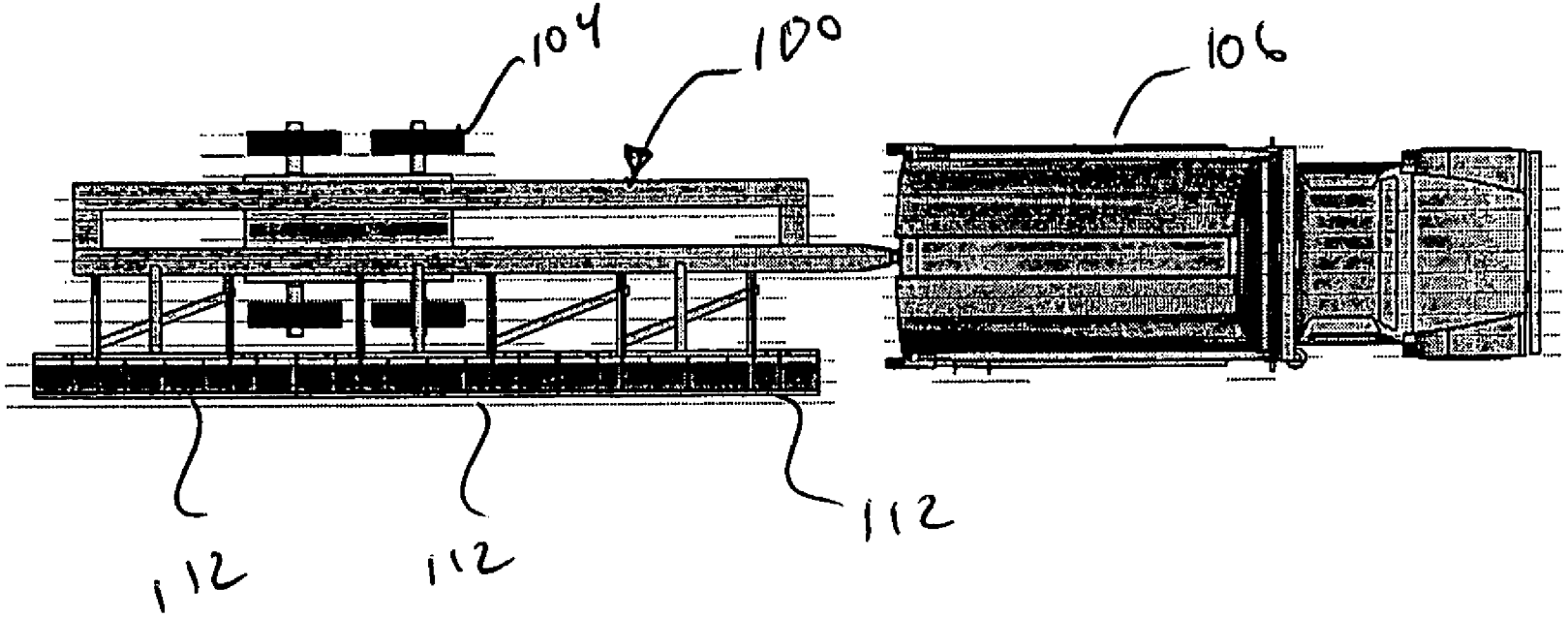
FIG. 2 is a top view of the towing vehicle and towed snowplow of FIG. 1 with the towed snowplow in a transport position behind the towing vehicle.

With reference now to FIG. 2, when the plane of each of the wheels 104 is aligned with the centerline of the vehicle 106, the towed snowplow will assume the transport position in which the towed snowplow is directly behind the towing vehicle. In order to facilitate transport of the towed snowplow without undue disruption of traffic and to comply with various width restrictions on interstate highway systems, it is preferably that the overall width of the towed snowplow be generally the same as the width of the towing vehicle or less. As shown in FIG. 2, the towed snowplow may extend slightly beyond the overall width of the towing vehicle while still satisfying the width restrictions for various highway systems.

Figure 3:
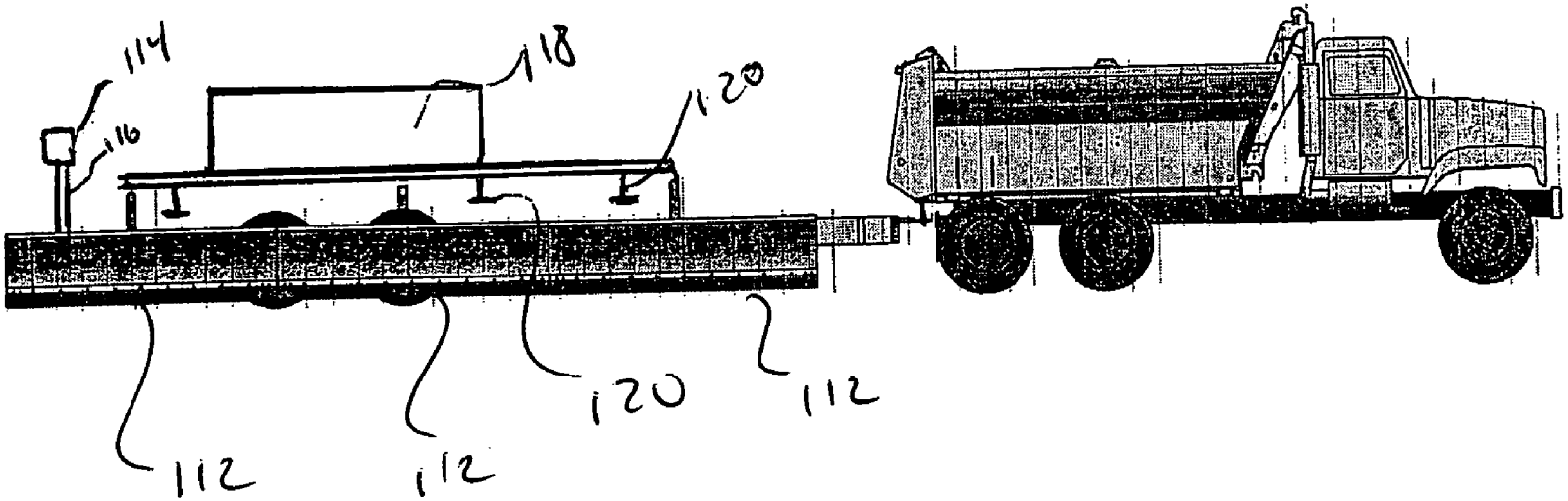
FIG. 3 is a side view of a modified version of the towing vehicle and towed snowplow of FIG. 1 according to another preferred embodiment of the present invention.

With reference now to FIG. 3, the towed snowplow 100 preferably has an arrangement of warning lights 114 which are preferably mounted at the trailing end of the towed snowplow. If desired, the arrangement of warning lights may be mounted on a rotatable mounting post 116 which is arranged to rotate with the movement of the wheels 104. In this way, the arrangement of warning lights 114 will directly face the oncoming traffic regardless of the position of the towed snowplow with respect to the towing vehicle. In addition, warning lights (not shown) may be provided along the length of the frame 102 to provide additional notice to following traffic of the towing operation. Those warning lights are mounted on the left side of the towed snowplow of FIG. 2 in order to be directed rearwardly when the towed snowplow is in the deployed position (see FIG. 1).

With continued reference to FIG. 3, the towed snowplow may also be provided with one or more bins or tanks or compartments 118 which are preferably mounted over the axles and the tanks should maintain a low center of gravity, mounted as low as possible in order to provide ballast and additional traction especially in icy pavement conditions. The compartments 118 may contain salt, sand, gravel, or a deicing fluid which is arranged to be sprayed or distributed behind the moldboards 112, as desired, such as by spinners 120.

Figure 4:
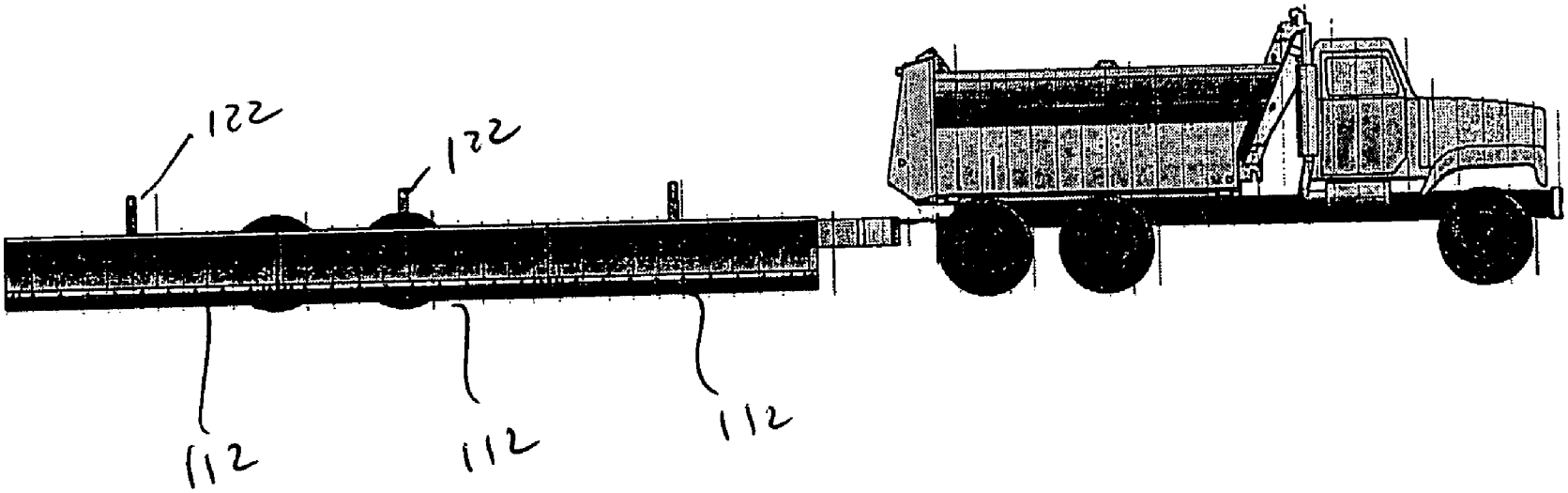
FIG. 4 is a right side view of the towing vehicle and towed snowplow of FIG. 1 showing the moldboard side of the towed plow in the transport position.

With reference now to FIG. 4, the towed snowplow is shown in the transport position with the moldboards raised relative to the pavement to be plowed. If desired, arms 122 may be provided above each of the moldboards 112 to facilitate raising and lowering of the moldboard on the towed snowplow (see also FIGS. 6 and 7). The arms 122 are raised and lowered by hydraulic cylinders 123 provided for each arm 122.

Figure 5:
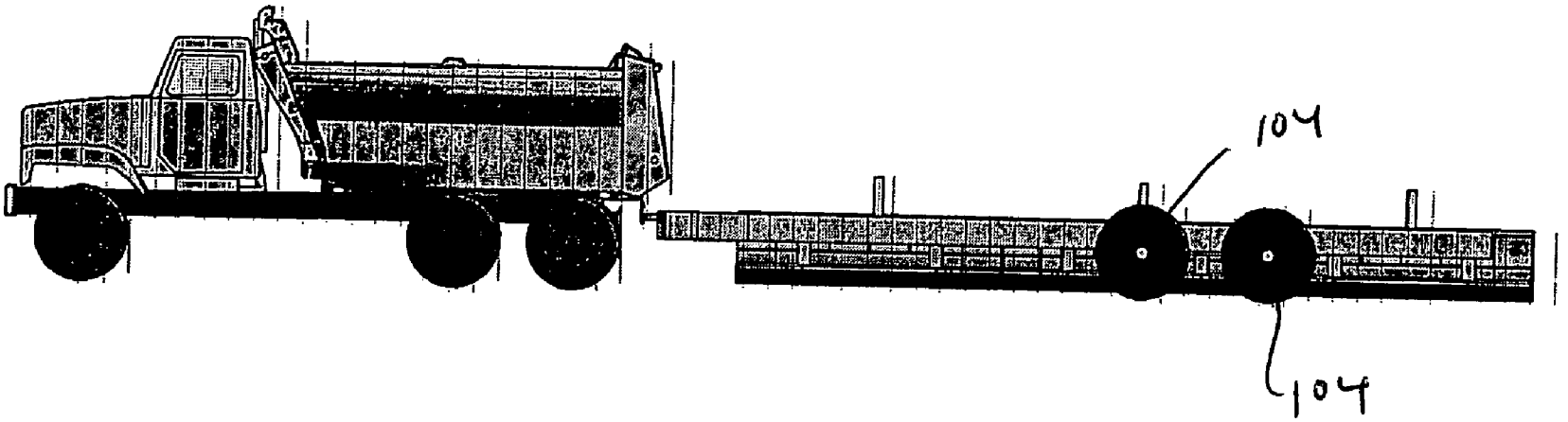
FIG. 5 is a left side view of the towing vehicle and towed snowplow of FIG. 1 in the transport position.

With reference now to FIG. 5, the left side of the towed snowplow and towing vehicle is shown. If desired, fenders (not illustrated) may be provided for the wheels of the towed snowplow.

Figure 6:
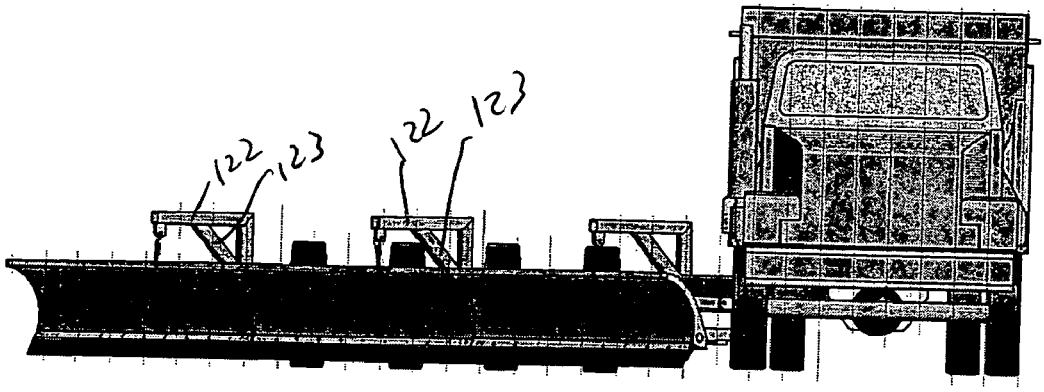
FIG. 6 is a front view of the towing vehicle and towed snowplow of FIG. 1 with the towed snowplow in the deployed position.
Figure 7:
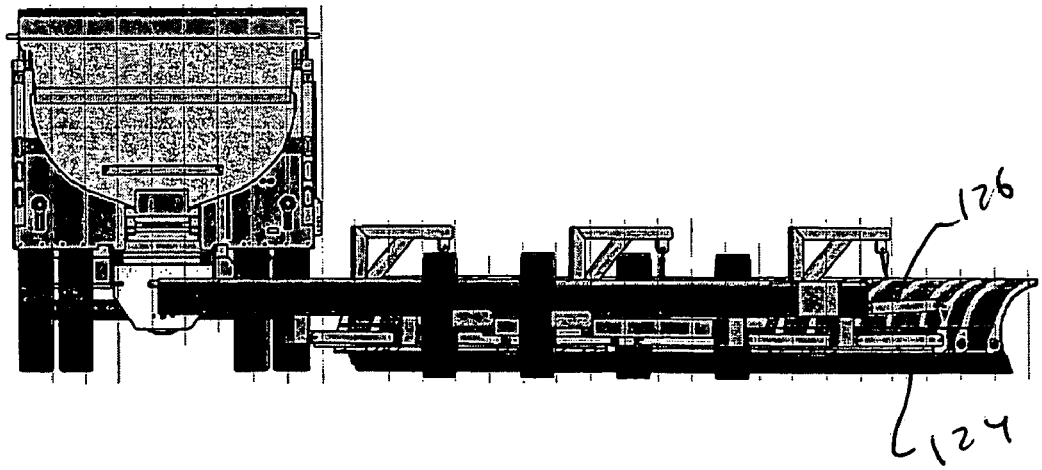
FIG. 7 is a rear view of the towing vehicle and towed snowplow of FIG. 1 with the towed snowplow in the deployed position.

In FIGS. 6 and 7, the front and rear views of the towed snowplow in the deployed position are illustrated with the moldboards still in the raised position. In order to perform a plowing operation, the moldboards would be lowered so as to have the lowermost edge of the moldboard contact the pavement or roadway.

In FIG. 7, an arrangement for mounting the moldboards on the frame is shown although various other suitable, conventional arrangements for mounting the moldboards on the frame will be readily apparent to one skilled in the art of snowplows. In general, support members 124 and 126 are provided to orient upper and lower portions of the moldboard with respect to the frame so as to position the moldboard in a desired configuration for efficient plowing.

Figure 8:
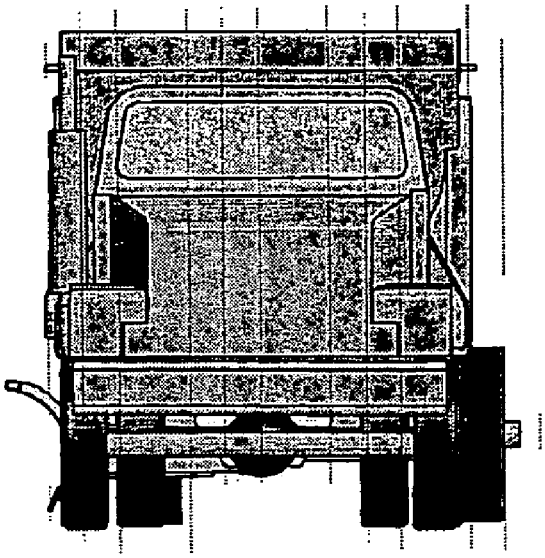
FIG. 8 is a front view of the towing vehicle and towed snowplow of FIG. 1 with the towed snowplow in the transport position.
Figure 9:
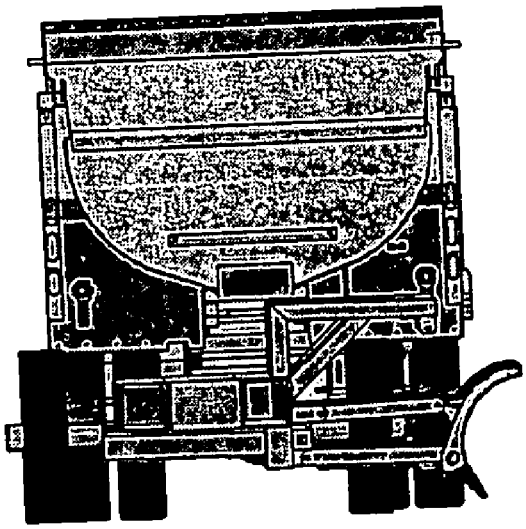
FIG. 9 is a rear view of the towing vehicle and towed snowplow of FIG. 1 with the towed snowplow in the transport position.

With reference to FIG. 8, a front view of the towing vehicle with the towed snowplow in the transport position is shown. In the embodiment of FIG. 8, the left side wheels of the towed snowplow extend slightly beyond the left edge of the vehicle and similarly the leading edge of the moldboard(s) extends slightly beyond the right edge of the vehicle. If desired, the towed snowplow may be configured more narrowly so as not to extend beyond the overall width of the towing vehicle. In any event, it is generally desirable that the overall width of the towed snowplow be less than about 102 inches so as to comply with typical interstate highway system width requirements.

With reference to FIG. 10, a towing vehicle and towed snowplow arrangement is shown in which the towing vehicle includes a front plow 130. The front plow 130 includes a moldboard 132 which may be oriented at various angles relative to the vehicle to accommodate different plowing situations. Typically, the width of the front moldboard will be equal to or slightly greater than the overall or effective width of the towed snowplow when in the transport position.

If desired, the steering may be configured so that in the event of a loss of steering control (such as a loss of hydraulic fluid to the steering mechanism for the wheels), the wheels will automatically assume the transport position so that the towed snowplow will move to the transport position directly behind the towing vehicle. Additionally, the towed snowplow may be provided with its own power unit or with an electrical steering mechanism that may be radio controlled. It is desirable, however, that the towed snowplow be steerable from the cab of the towing vehicle so that an additional operator is not required for the towed snowplow.

To perform a plowing operation using the towed snowplow of the present invention, the snowplow is pivotably connected to the towing vehicle and the one or more wheels are placed in the transport position with the plane of the wheels aligned with the longitudinal axis of the towed snowplow. In this configuration, the towed snowplow may be transported by the vehicle to a location where the plowing operation is to commence. When desired, the operator of the towing vehicle causes the wheels to move to a deployed position in which the plane of the wheels makes an angle generally between 0 degrees and 90 degrees and more preferably between about 0 degrees and 45 degrees and most preferably about 45 degrees with respect to the longitudinal axis of the towed snowplow. As a result, the towed snowplow moves from the transport position to the deployed position generally diagonal with respect to the towing vehicle. When desired, the moldboard(s) are then lowered and the plowing operation commences. When desired, the moldboard(s) are lifted and the wheels are moved back to the transport position which causes the towed snowplow to move from the deployed position to the transport position directly behind the towing vehicle.

In the preferred embodiments of the present invention, the towed snowplow is configured to plow either to the left or to the right of the towing vehicle. However, the towed snowplow could also be arranged to plow both to the right and left of the towing vehicle. Especially if the towed snowplow may exceed the width of a standard lane of traffic (such as 12'), the towed snowplow can be equipped with both left and right moldboards either on a single frame or on separate complementary frames which can be deployed to either side of a towing vehicle. For example, such an arrangement would be particularly suitable for use in clearing strips of pavement such as airport runways. The left and right towed snowplows could be towed by a common hitch arrangement on the vehicle or the towing vehicle could be provided with two different hitch arrangements to tow left and right towed snowplows. In addition, the left and right towed snowplows may each be independently deployed to a plowing position behind the vehicle. In this way, the vehicle could be used as desired to plow to the left of the vehicle, to the right of the vehicle or to both the left and right of the vehicle simultaneously.

The left and the right towed snowplows may be relatively narrow in construction and may have the wheel arrangements in complementary positions so that the two towed snowplows may have a combined width of only one lane of traffic when in the transport configuration. In such a configuration, the left and right towed snowplows may have an extendable connection between the two towed snowplows, if desired, to maintain the diagonal orientation of the snowplows with respect to the vehicle during a plowing operation.

If desired, the wheels for the towed snowplow may be provided in a subframe or carriage which is rotatable relative to a mainframe which carries the moldboards. For example, the subframe or carriage may have a ring gear which is driven by a geared motor mounted on the mainframe of the towed snowplow. By using the motor to rotate the ring gear, the orientation of the subframe or carriage relative to the mainframe may be varied to move the towed snowplow from the transport position to a deployed position and back again.

The towed snowplow according to the present invention may be equipped with more than one cutting edge. For example, the towed snowplow may have a first moldboard (or series of first moldboards extending along the length of the towed snowplow) with a steel edge. In addition, another moldboard (or series of second moldboards) with a rubber or squeegee edge may be provided on the towed snowplow. Likewise, if desired, a blowing system may be provided on the towed snowplow with any associated power unit mounted on the towed snowplow or on the towing vehicle as desired.

In the preferred embodiments of the towed snowplow according to the present invention, the towed snowplow may preferably be operated at an angle with respect to the towing vehicle of about 45 degrees or less. Typically, a front mounted moldboard on a vehicle has a normal plowing angle of about 45 degrees up to about 60 degrees. Accordingly, the towed snowplow provides additional safety during plowing operations because bridge expansion and other expansion joints are generally oriented at about 60 to 90 degrees with respect to a centerline of a highway. As a result, front plows, wing plows and underbody plows have a cutting angle which often matches the expansion joint angle. By operating a towed snowplow according to the present invention at an angle of about 45 degrees or less with respect to the towing vehicle, the likelihood that the towed snowplow moldboard edge will fall into such joints is significantly reduced.

As desired, the towed snowplow according to the present invention can be deployed not only onto the shoulder but also either down or up slopes which extend beyond the edge of the pavement or shoulder being plowed. In this way, areas not typically accessible to plowing by front plow moldboards and side wing moldboards may be cleared of snow which accordingly provides additional adjacent storage room along the roadway for drifting snow and to facilitate future plowing.

The towed snowplow may be provided with one or more storage containers, preferably generally above the wheel or wheels of the towed snowplow to provide additional traction and reduce slipping and sliding of the towed snowplow. Such storage containers may have associated spraying or discharging arrangements to distribute salt, sand, gravel or deicing compositions during the plowing operation. In addition, the storage containers on the towed snowplow may likewise provide the plowing truck with an additional payload of salt, brine or other materials in liquid or solid form.

Accordingly, the towed snowplow according to the present invention when hooked to one truck and using one operator can clear in one pass the amount of pavement cleared by two or more trucks (and two or more operators) not equipped with towed snowplows in plowing situations.

As desired, the towed snowplow can be unhooked from the towing vehicle and left, for example for blade change out or for repair, while permitting the truck to continue plowing operations with the vehicle's front plow. Because of its relatively narrow width, the towed snowplow according to the present invention can be pulled into maintenance shops through typical conventional door for accommodating plowing vehicles. If the vehicle's front plow is disabled or removed such as for service, the towed snowplow can remain on the truck and continue to be used for plowing operations.

The towed snowplow can be used by state, municipal or federal transportation departments or other agencies, yet, if desired, be hooked to private or commercial trucks by using their pintle or other hitches, without requiring unusual or specific mounting equipment or configuration on the towing vehicle. During significant snow storms, governmental agencies typically need to pay for mounting and removing specialized equipment on contractors' trucks. These charges may be avoided since the towed snowplow according to the preferred embodiments of the present invention do not require the towing vehicle to have any unusual or specific equipment to tow and steer the towed snowplow.

Because the towed snowplow preferably has a plurality of moldboards provided along the length of the snowplow, the towed snowplow is able to generally contour to the roadway cross section and as well to inslopes.

Towed snowplows having a relatively shorter length of about 10' to 30' can be used to clear mainline and shoulders in one pass at high speeds, (i.e., speeds generally over about 40 MPH). Relatively longer towed snowplows having a length of about 40' or more can clear over 30' when pulled by a towing vehicle which has a front plow, thus replacing two or more trucks for runway and other surfaces. If desired, the towed snowplow (especially the longer towed snowplows) may be provided with brakes actuated either automatically with the vehicle's brakes or independently. Similarly, it may be desired or necessary to provided the relatively long towed snowplows (especially those over 40' long) with full time ballast to reduce side drift. As desired, the wheel or wheels of the towed snowplow may be provided with chains or cables and may be configured as driven wheels to assist in the plowing operation.

The towed snowplow should be provided with adequate lighting and safety signage to alert other vehicles of the plowing operation and to prevent or discourage vehicles from following too closely or from attempting to pass the vehicle and the towed snowplow.

The towed snowplow according to the present invention is particularly suitable for use in mountainous situations. In such use, if the towed snowplow is deployed and slides off the slope, the natural tendency of the moldboard is to cut into the shoulder point and ski directly toward the hitch point of the towing vehicle. The relatively light weight of the towed snowplow will allow the considerably heavier truck to pull the towed snowplow back into the deployed position or back into a towed position without difficulty.

The towed snowplow can be towed behind a plow truck while negotiating the tightest of turns especially if the towed snowplow is equipped with left and right steering for the wheels.

For safety reasons, in the configuration shown for deployment to the right of the vehicle, the towed snowplow is normally restricted to only a 3 to 5 degree left steering and full right steering. In mountain switch back situations, the left steering can unlock and be used to negotiate curves and turns.

The towed snowplow steering can also be used to facilitate backing of the towed snowplow as well as towing in tight situations. If desired, a mirror image of the illustrated right side towed snowplow can be provided for a towing vehicle so as to enable plowing of left passing shoulders. Especially in mountain plowing operations, a relatively small configuration of the towed snowplow may be desirable to plow to the right of the vehicle beyond the edge of the front plow without jeopardizing the towing vehicle. The towed snowplow can quickly recover because the cutting edge and towed snowplow ski will automatically cause the towed snowplow to seek the direction of the truck hitch.

In airport plowing operations, a tandem towed snowplow arrangement can be deployed to allow one truck and one operator to clear 60 or more feet with only one truck. The relatively wide clearing path allows the towing vehicle and towed snowplow to quickly clear light snow between aircraft landings. The towed snowplow can incorporate a blower to compliment the moldboard cutting edge or to blow snow off a runway.

In parking lot plowing, the relatively light weight of the towed snowplow can be used by smaller trucks to plow parking lots as well as by trucks which do not have front plows.

The principles, preferred embodiments and mode of operation of the present invention have been described in the foregoing specification. However, the invention which is intended to be protected is not to be construed as limited to the particular embodiments disclosed. The embodiments are therefore to be regarded as illustrative rather than as restrictive. Variations and changes may be made without departing from the spirit of the present invention. Accordingly, it is expressly intended that all such equivalents, variations and changes which fall within the spirit and scope of the present invention as defined in the claims be embraced thereby.

What is claimed is:

1. A snowplow arranged to be towed behind a vehicle, comprising:

a frame, said frame having a longitudinal axis;

at least one wheel, said frame being carried by said at least one wheel, said wheel being selectively movable between a first position and a second position, said wheel being generally aligned with said longitudinal axis of said frame when said wheel is in said first position and said wheel being selectively angled with respect to said longitudinal axis of said frame when said wheel is in said second position;

means for pivotably connecting said frame to a vehicle whereby said frame may be towed by said vehicle;

at least one moldboard carried by said frame, wherein said at least one moldboard may be selectively raised and lowered with respect to generally said entire frame while said moldboard is being carried by said frame;

said frame extending generally from a point where said frame is pivotably connected to said vehicle to a point which is beyond said at least one moldboard carried by said frame.

2. The snowplow of claim 1, wherein said at least one wheel is steerable.

3. The snowplow of claim 2, wherein said at least one wheel is remotely steerable.

4. A snowplow arranged to be towed behind a vehicle, comprising:

a frame, said frame having a longitudinal axis;

a plurality of wheels, said plurality of wheels being mounted on said frame, said frame being carried by said plurality of wheels, said plurality of wheels being selectively movable between a first position and a second position, each wheel of said plurality of wheels being generally aligned with said longitudinal axis of said frame when said plurality of wheels is in said first position and each of said wheels of said plurality of wheels being selectively angled with respect to said longitudinal axis of said frame when said plurality of wheels is in said second position;

means for pivotably connecting said frame to a vehicle whereby said frame may be towed by said vehicle;

a plurality of moldboards carried by said frame, wherein said plurality of moldboards may be selectively raised and lowered generally with respect to said entire frame while said plurality of moldboards is being carried by said frame;

said frame extending at least generally from a point where said frame is pivotably connected to said vehicle to said plurality of wheels mounted on said frame.

5. The snowplow of claim 4, wherein said frame is towed generally directly behind said vehicle when said plurality of wheels is in said first position and said frame is towed generally diagonally with respect to a centerline of said vehicle when said plurality of wheels is in said second position.

6. The snowplow of claim 4, wherein said plurality of wheels is steerable from said vehicle.

7. The snowplow of claim 4, wherein said frame defines a length and a width, a lowermost edge of each of said plurality of moldboards together extending generally along said entire length of said frame.

8. The snowplow of claim 4, wherein said frame extends generally from a point where said frame is pivotably connected to said vehicle to a point which is beyond said plurality of moldboards carried by said frame.

9. The snowplow of claim 4, wherein each of said plurality of moldboards may be selectively raised and lowered with respect to said frame from within said vehicle.

10. The snowplow of claim 7, wherein said snowplow defines an overall width and an overall length, said overall width of said snowplow being about 102 inches.

11. The snowplow of claim 7, wherein said snowplow defines an overall width and an overall length, said overall width of said snowplow being generally 102 inches or less.

12. The snowplow of claim 7, wherein said plurality of moldboards together defines an overall length, said overall length of said plurality of moldboards being sufficient to plow at least 120 inches of pavement.

13. A combination snowplow truck and towed snowplow, comprising:

a truck provided with a front snowboard having a front moldboard which may be selectively raised and lowered;

a towed snowplow, said towed snowplow comprising a frame pivotably connected to said truck at a rear end of said truck, said frame having a longitudinal axis, and a plurality of wheels, said frame being carried by said plurality of wheels, said plurality of wheels being selectively movable between a first position and a second position, each wheel of said plurality of wheels being generally aligned with said longitudinal axis of said frame when said plurality of wheels is in said first position and each of said wheels of said plurality of wheels being selectively angled with respect to said longitudinal axis of said frame when said plurality of wheels is in said second position, and a plurality of moldboards carried by said frame, wherein said plurality of moldboards may be selectively raised and lowered generally with respect to said entire frame while said plurality of moldboards is being carried by said frame.

14. The combination snowplow truck and towed snowplow of claim 13, wherein said frame is towed generally directly behind said truck when said plurality of wheels is in said first position and said frame is towed generally diagonally with respect to a centerline of said truck when said plurality of wheels is in said second position.

15. The combination snowplow truck and towed snowplow of claim 14, wherein said plurality of wheels is steerable from said truck.

16. The combination snowplow truck and towed snowplow of claim 15, wherein said frame defines a length and a width, a lowermost edge of each of said plurality of moldboards together extending generally along said entire length of said frame and wherein said plurality of moldboards may be selectively raised and lowered with respect to said frame from within said truck.

17. The combined snowplow truck and towed snowplow of claim 16, wherein said towed snowplow defines an overall width and an overall length, said overall width of said towed snowplow being about 102 inches.

18. The combined snowplow truck and towed snowplow of claim 17, wherein said plurality of moldboards of said towed snowplow together defines an overall length, said overall length of said plurality of moldboards of said towed snowplow being sufficient to plow at least 120 inches of pavement when said towed snowplow is in said deployed position.

19. A method of plowing snow from pavement, comprising the steps of:

towing a frame behind a vehicle from a rear hitch, said frame being carried by at least one wheel;

moving said frame from a transport position with said frame positioned directly behind said vehicle to a deployed position in which said frame extends diagonally from said rear hitch of said vehicle;

lowering at least one moldboard carried by said frame, generally relative to said entire frame, into a plowing position while said at least one moldboard is being carried by said frame;

using said at least one moldboard to plow snow from pavement in a path alongside said vehicle;

raising said at least one moldboard, generally relative to said entire frame, out of said plowing position while said at least one moldboard is being carried by said frame; and, moving said frame from said deployed position back to said transport position.

20. A snowplow arranged to be towed behind a vehicle, comprising:

a frame, said frame having a longitudinal axis;

at least one wheel, said frame being carried by said at least one wheel, said wheel being steerable between a first position and a second position, said wheel being generally aligned with said longitudinal axis of said frame when said wheel is in said first position and said wheel being selectively angled with respect to said longitudinal axis of said frame when said wheel is in said second position;

at least one moldboard carried by said frame, said moldboard having a lowermost edge which is generally parallel to said longitudinal axis of said frame, and, means for pivotably connecting said frame to a vehicle whereby said frame may be towed by said vehicle.

21. The snowplow of claim 20, wherein said at least one wheel is remotely steerable.

22. The snowplow of claim 20, wherein said at least one moldboard may be selectively raised and lowered with respect to said frame.

23. The snowplow of claim 20, further comprising:

a plurality of wheels, said frame being carried by said plurality of wheels, said plurality of wheels being steerable between a first position and a second position, each wheel of said plurality of wheels being generally aligned with said longitudinal axis of said frame when said plurality of wheels is in said first position and each of said wheels of said plurality of wheels being selectively angled with respect to said longitudinal axis of said frame when said plurality of wheels is in said second position;

a plurality of moldboards carried by said frame, each of said moldboards having a lowermost edge which is generally parallel to said longitudinal axis of said frame, said plurality of moldboards effectively forming a single moldboard surface that extends parallel to the longitudinal axis of the frame substantially along the length of said frame.

24. The snowplow of claim 23, wherein said plurality of moldboards may be selectively raised and lowered with respect to said frame.

25. The snowplow of claim 23, wherein each of said plurality of moldboards may be selectively raised and lowered with respect to said frame from within said vehicle.

26. The snowplow of claim 20, wherein said frame is freely pivotable with respect to said vehicle when said wheel is in said second position.

27. The snowplow of claim 23, wherein said frame is freely pivotable with respect to said vehicle when said wheels are in said second position.

28. A combination snowplow truck and towed snowplow, comprising:

a truck provided with a moldboard, mounted on said truck, which moldboard may be selectively raised and lowered;

a towed snowplow, said towed snowplow comprising a frame freely pivotably connected to said truck at a rear end of said truck, said frame having a longitudinal axis, and a plurality of wheels, said frame being carried by said plurality of wheels, said plurality of wheels being steerable between a first position and a second position, each wheel of said plurality of wheels being generally aligned with said longitudinal axis of said frame when said plurality of wheels is in said first position and each of said wheels of said plurality of wheels being selectively angled with respect to said longitudinal axis of said frame when said plurality of wheels is in said second position, and a plurality of moldboards carried by said frame, said plurality of moldboards each having a lowermost edge which is generally parallel to said longitudinal axis, said plurality of moldboards together effectively forming a single moldboard extending substantially along the length of said frame.

29. The combined snowplow truck and towed snowplow of claim 28, wherein said plurality of moldboards of said towed snowplow together defines an overall length, said overall length of said plurality of moldboards of said towed snowplow being sufficient to plow at least 120 inches of pavement when said towed snowplow extends generally diagonally with respect to a centerline of said truck.

30. A method of plowing snow from pavement, comprising the steps of:

towing a frame behind a vehicle from a rear hitch, said frame being carried by at least one wheel;

moving said frame from a transport position with said frame positioned directly behind said vehicle to a deployed position in which said frame extends diagonally from said rear hitch of said vehicle by steering said at least one wheel of said frame;

lowering at least one moldboard carried by said frame generally relative to said entire frame while said at least one moldboard is being carried by said frame, whereby said at least one moldboard is in a plowing position;

using said at least one moldboard to plow snow from pavement in a path alongside said vehicle;

raising said at least one moldboard generally relative to said entire frame out of said plowing position, while said at least one moldboard is being carried by said frame; and, moving said frame from said deployed position back to said transport position by steering said at least one wheel of said frame.

* * * * *